US008564512B2

(12) United States Patent
Chung

(10) Patent No.: US 8,564,512 B2
(45) Date of Patent: Oct. 22, 2013

(54) PIXEL CIRCUIT FOR DRIVING TRANSISTOR THRESHOLD VOLTAGE COMPENSATION AND ORGANIC ELECTROLUMINESCENT DISPLAY APPARATUS USING THE SAME

(75) Inventor: Kyung-Hoon Chung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 536 days.

(21) Appl. No.: 12/832,924

(22) Filed: Jul. 8, 2010

(65) Prior Publication Data

US 2011/0115764 A1 May 19, 2011

(30) Foreign Application Priority Data

Nov. 16, 2009 (KR) ..... 10-2009-0110362

(51) Int. Cl.
*G09G 3/32* (2006.01)

(52) U.S. Cl.
USPC ..... 345/82

(58) Field of Classification Search
USPC ..... 345/76–83; 315/169.3
See application file for complete search history.

(56) References Cited

U.S. PATENT DOCUMENTS

| | | | | |
|---|---|---|---|---|
| 2006/0132055 | A1* | 6/2006 | Kwak | 315/169.3 |
| 2006/0238461 | A1* | 10/2006 | Goh et al. | 345/76 |
| 2007/0296652 | A1* | 12/2007 | Imamura et al. | 345/76 |
| 2009/0109150 | A1* | 4/2009 | Han et al. | 345/82 |
| 2009/0207105 | A1* | 8/2009 | Hwang et al. | 345/76 |
| 2010/0123700 | A1* | 5/2010 | Kim et al. | 345/211 |
| 2011/0063198 | A1 | 3/2011 | Chung et al. | |

FOREIGN PATENT DOCUMENTS

| | | |
|---|---|---|
| KR | 10-2005-0110458 | 11/2005 |
| KR | 10-2008-0050113 | 6/2008 |
| KR | 10-2008-0082118 | 9/2008 |
| KR | 10-2009-0016050 | 2/2009 |
| KR | 10-2009-0046053 | 5/2009 |
| KR | 10-2011-0028996 | 3/2011 |

OTHER PUBLICATIONS

KIPO Office action dated Jul. 29, 2011, for Korean Patent application 10-2009-0110361, 5 pages.
KIPO Office action dated Jul. 29, 2011, for Korean priority Patent application 10-2009-0110362, 5 pages.
KIPO Office action dated Apr. 21, 2011, for Korean Patent application 10-2009-0110361, noting listed reference in this IDS, 5 pages.

* cited by examiner

*Primary Examiner* — Chanh Nguyen
*Assistant Examiner* — Sanghyuk Park
(74) *Attorney, Agent, or Firm* — Christie, Parker & Hale, LLP

(57) ABSTRACT

An improved pixel circuit including N-type transistors is provided. The pixel circuit includes a light emitting device driven by a driving current according to a gate voltage of a driving transistor. The pixel circuit also includes a first capacitor, a second transistor for transferring a data signal to a first terminal of the first capacitor in response to a scan control signal, a third transistor for diode-connecting the driving transistor in response to the scan control signal, a fourth transistor for applying a first power voltage to a first electrode of the driving transistor in response to an emission control signal, a fifth transistor for applying a sustain voltage to the first terminal of the first capacitor in response to the emission control signal, and a sixth transistor for applying the first power voltage to a second terminal of the first capacitor in response to an initialization control signal.

16 Claims, 8 Drawing Sheets

RELATED ART

PIXEL CIRCUIT FOR DRIVING TRANSISTOR THRESHOLD VOLTAGE COMPENSATION AND ORGANIC ELECTROLUMINESCENT DISPLAY APPARATUS USING THE SAME

CROSS-REFERENCE TO RELATED APPLICATIONS

This application claims priority to and the benefit of Korean Patent Application No. 10-2009-0110362, filed on Nov. 16, 2009, in the Korean Intellectual Property Office, the disclosure of which is incorporated herein in its entirety by reference.

BACKGROUND

1. Field

An aspect of embodiments of the present invention relates to a pixel circuit and an organic electroluminescent display apparatus using the pixel circuit.

2. Description of the Related Art

An organic electroluminescent display apparatus displays an image by using organic light emitting diodes (OLEDs) which generate light by electron-hole recombination. The organic electroluminescent display apparatus has a fast response speed and low power consumption. In the organic electroluminescent display apparatus, data driving signals corresponding to input data are applied to a plurality of pixel circuits to adjust brightness of each pixel, and the input data are converted to an image and provided to a viewer.

SUMMARY

Exemplary embodiments of the present invention provide a pixel circuit which may reduce the influence of the threshold voltage of a driving transistor and the second power voltage applied at the cathode electrode of an organic light emitting diode (OLED), on the driving current input to the OLED, when an organic electroluminescent display apparatus is implemented by using N-type transistors, and an organic electroluminescent display apparatus using the pixel circuit.

According to an embodiment of the present invention, a pixel circuit includes a light emitting device including a first electrode and a second electrode, a driving transistor including a first electrode and a second electrode and for outputting a driving current according to a voltage applied to a gate electrode of the driving transistor, a first capacitor including a first terminal and a second terminal coupled to the gate electrode of the driving transistor, a second transistor for transferring a data signal to the first terminal of the first capacitor in response to a scan control signal applied to a gate electrode of the second transistor, a third transistor for diode-connecting the driving transistor in response to the scan control signal applied to a gate electrode of the third transistor, a fourth transistor for applying a first power voltage to the first electrode of the driving transistor in response to an emission control signal, a fifth transistor for applying a sustain voltage to the first terminal of the first capacitor in response to the emission control signal, and a sixth transistor for applying the first power voltage to the second terminal of the first capacitor in response to an initialization control signal, in which the driving transistor and the second to sixth transistors are N-type transistors.

The driving transistor and the second to sixth transistors may be N-type metal oxide semiconductor field effect transistors (MOSFETs).

The second transistor may include a first electrode coupled to a data line and a second electrode coupled to the first terminal of the first capacitor, and the third transistor may include a first electrode coupled to the gate electrode of the driving transistor and a second electrode coupled to the first electrode of the driving transistor.

The scan control signal and the emission control signal may be signals applied to an n-th row of pixels, and the initialization control signal may be a signal applied to an (n−1)th row of pixels.

The first electrode of the driving transistor may be a drain electrode, and the second electrode of the driving transistor may be a source electrode.

The light emitting device may be an organic light emitting diode (OLED).

The pixel circuit may further include a second capacitor including a first terminal coupled to the gate electrode of the driving transistor and a second terminal coupled to the first electrode of the light emitting device.

The pixel circuit may further include a seventh transistor for applying a reference voltage to the first electrode of the light emitting device in response to the scan control signal applied to a gate electrode of the seventh transistor.

The reference voltage may be substantially the same as the sustain voltage.

The scan control signal and the emission control signal may be driven in a first period, a second period, and a third period. In the first period, a previous scan control signal may be at a first level, and the emission control signal and the scan control signal may be at a second level. In the second period, the data signal at an effective level may be applied to the pixel circuit, the previous scan control signal may be at the second level, the scan control signal may be at the first level, and the emission control signal may be at the second level. In the third period, the previous scan control signal may be at the second level, the scan control signal may be at the second level, and the emission control signal may be at the first level. Here, the first level may be a level at which the driving transistor and the second to sixth transistors are turned on, and the second level may be a level at which the driving transistor and the second to sixth transistors are turned off.

According to another embodiment of the present invention, an organic electroluminescent display apparatus includes a plurality of pixels, a first scan driver for outputting an emission control signal to each of the plurality of pixels and a second scan driver for outputting a scan control signal, and a data driver for generating a data signal and outputting the generated data signal to each of the plurality of pixels, in which each of the plurality of pixels include an organic light emitting diode including an anode electrode and a cathode electrode, a driving transistor including a first electrode and a second electrode and for outputting a driving current according to a voltage applied to a gate electrode of the driving transistor, a first capacitor including a first terminal and a second terminal coupled to the gate electrode of the driving transistor, a second transistor for transferring the data signal to the first terminal of the first capacitor in response to an n-th scan control signal applied to a gate electrode of the second transistor, a third transistor for diode-connecting the driving transistor in response to the n-th scan control signal applied to a gate electrode of the third transistor, a fourth transistor for applying a first power voltage to the first electrode of the driving transistor in response to the emission control signal, a fifth transistor for applying a sustain voltage to the first terminal of the first capacitor in response to the emission control signal, and a sixth transistor for applying the first power voltage to the second terminal of the first capacitor in response to an (n−1)th scan control signal, in which the driving transistor and the second to sixth transistors are N-type transistors.

The first electrode of the driving transistor may be a drain electrode, and the second electrode of the driving transistor may be a source electrode.

The organic electroluminescent device apparatus may further include a second capacitor including a first terminal coupled to the gate electrode of the driving transistor and a second terminal coupled to the anode electrode of the organic light emitting diode.

The organic electroluminescent device apparatus may further include a seventh transistor for applying a reference voltage to the anode electrode of the organic light emitting diode in response to the scan control signal applied to a gate electrode of the seventh transistor.

The reference voltage may be substantially the same as the sustain voltage.

The first scan driver and the second scan driver may be driven in a first period, a second period, and a third period. In the first period, the second scan driver may apply the (n−1)th scan control signal at a first level and the n-th scan control signal at a second level, and the first scan driver may apply the n-th emission control signal at the second level. In the second period, the data driver may apply the data signal at an effective level to the pixel circuit, the second scan driver may apply the (n−1)th scan control signal at the second level and the n-th scan control signal at the first level, and the first scan driver may apply the n-th emission control signal at the second level. In the third period, the second scan driver may apply the (n−1)th scan control signal at the second level and the n-th scan control signal at the second level, and the first scan driver may apply the n-th emission control signal at the first level, in which the first level may be a level at which the driving transistor and the second to sixth transistors are turned on, and the second level may be a level at which the driving transistor and the second to sixth transistors are turned off.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

An organic electroluminescent display apparatus generates light by electrically exciting a fluorescent organic compound. In the organic electroluminescent display apparatus, an image may be presented by driving a plurality of pixels arranged in a matrix format. The organic light emitting element included in the pixel has a diode characteristic and is referred to as an organic light emitting diode (OLED).

Figure 1:
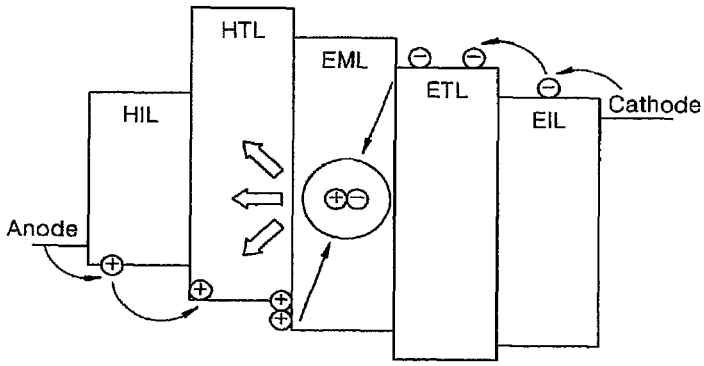
FIG. 1 conceptually illustrates the structure of an OLED.

FIG. 1 conceptually illustrates the structure of the OLED. Referring to FIG. 1, the OLED has a structure that includes an anode electrode layer (Anode) formed of ITO, an organic thin layer, and a cathode electrode layer (Cathode) formed of metal. The organic thin layer may further include an emitting layer (EML), an electron transport layer (ETL), and a hole transport layer (HTL), to facilitate the balance between electrons and holes to improve light emitting efficiency. In addition, the organic thin layer may further include a hole injecting layer (HIL) or an electron injecting layer (EIL). The OLED may be driven in accordance with a data voltage level that is stored in a capacitor connected to a gate electrode of a thin film transistor (TFT) connected to the anode electrode of the OLED.

Figure 2:
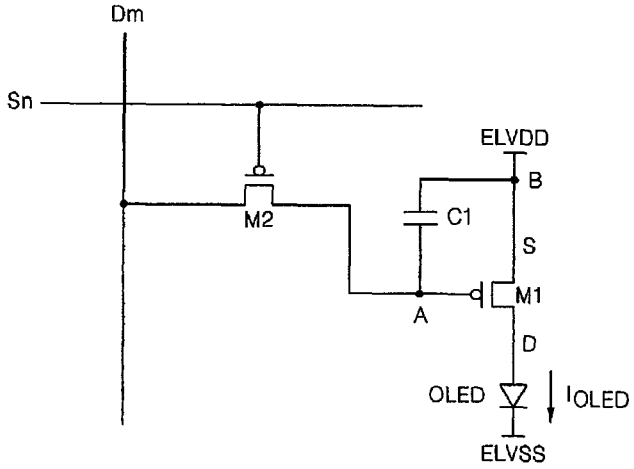
FIG. 2 is a circuit diagram of a pixel circuit including P-type transistors.

FIG. 2 is a circuit diagram of a pixel circuit including P-type transistors. Referring to FIG. 2, a switching transistor M2 is turned on by a selection signal from a selection scan line Sn. As the switching transistor M2 is turned on, a data voltage is transferred from a data line Dm to a gate electrode of a driving (or first) transistor M1. A potential difference between the data voltage and a first power voltage ELVDD is stored in a capacitor C1 that is connected between the gate electrode and a source electrode of the driving transistor M1. A drive current $I_{OLED}$ flows through an OLED due to the potential difference so that the OLED may emit light. The OLED emits light with a brightness gradation according to the voltage level of the applied data voltage.

However, the driving transistors M1 of the pixel circuits may have different threshold voltages. When the threshold voltages of the driving transistors M1 are different from each other, the amount of current outputs from the driving transistors M1 of the pixel circuits differ so that a uniform image may not be formed. The deviation in the threshold voltages of the driving transistors M1 may become severe as the size of the organic electroluminescent display apparatus increases, which may result in the deterioration of the image quality of the organic electroluminescent display apparatus. Thus, for the pixel circuits of the organic electroluminescent display apparatus to have a uniform image quality, the threshold voltage of the driving transistor M1 in the pixel circuit should be compensated for.

In the pixel circuit of FIG. 2, the switching transistor M2 and the driving transistor M1 are formed of PMOS transistors. One terminal of the capacitor C1 is connected to the first power voltage ELVDD, and the other terminal of the capacitor C1 is connected to a node A. The source electrode of the driving transistor M1 is connected to the first power voltage ELVDD, and a drain electrode of the driving transistor M1 is connected to an anode electrode of the OLED.

In this case, the pixel circuit operates as a current source. The gate electrode of the driving transistor M1 is applied with the data voltage, and the source electrode of the driving transistor M1 is applied with the first power voltage ELVDD. That is, since the source electrode of the driving transistor M1 is fixed to the first power voltage ELVDD, the voltage has no influence on a voltage Vgs during the light emission of the OLED.

In another pixel circuit, the switching transistor M2 and the driving transistor M1 of FIG. 2 may be formed of N-type transistors. In this case, the capacitor C1 is connected between the gate electrode and the drain electrode of the driving transistor M1. Also, the source electrode of the driving transistor M1 is not connected to a fixed voltage source and is of a source follower type to which a load is connected. Thus, the voltage Vgs is affected by a second power voltage ELVSS applied at the cathode of the OLED and the voltage across the OLED during the light emission of the OLED. The second power voltage ELVSS may be a cathode power voltage.

The second power voltage ELVSS varies according to an IR drop due to a parasitic resistance element of a wiring for transferring the second power voltage and a voltage drop due to the current flowing into each pixel. As a result, in the pixel circuit implemented with the N-type transistors, the voltage at the source electrode of the driving transistor M1 is unstable so that brightness of an image may not be constant.

Also, in the pixel circuit implemented with the N-type transistors, the voltage across the OLED during the light emission of the OLED affects the voltage Vgs. Thus, the pixel circuit may be sensitive to deviation of a characteristic of the OLED according to the temperature of the OLED and its deterioration.

The attached drawings illustrate exemplary embodiments of the present invention. Hereinafter, the present invention will be described in detail by explaining exemplary embodiments of the present invention with reference to the attached drawings. Like reference numerals in the drawings denote like elements.

Figure 3:
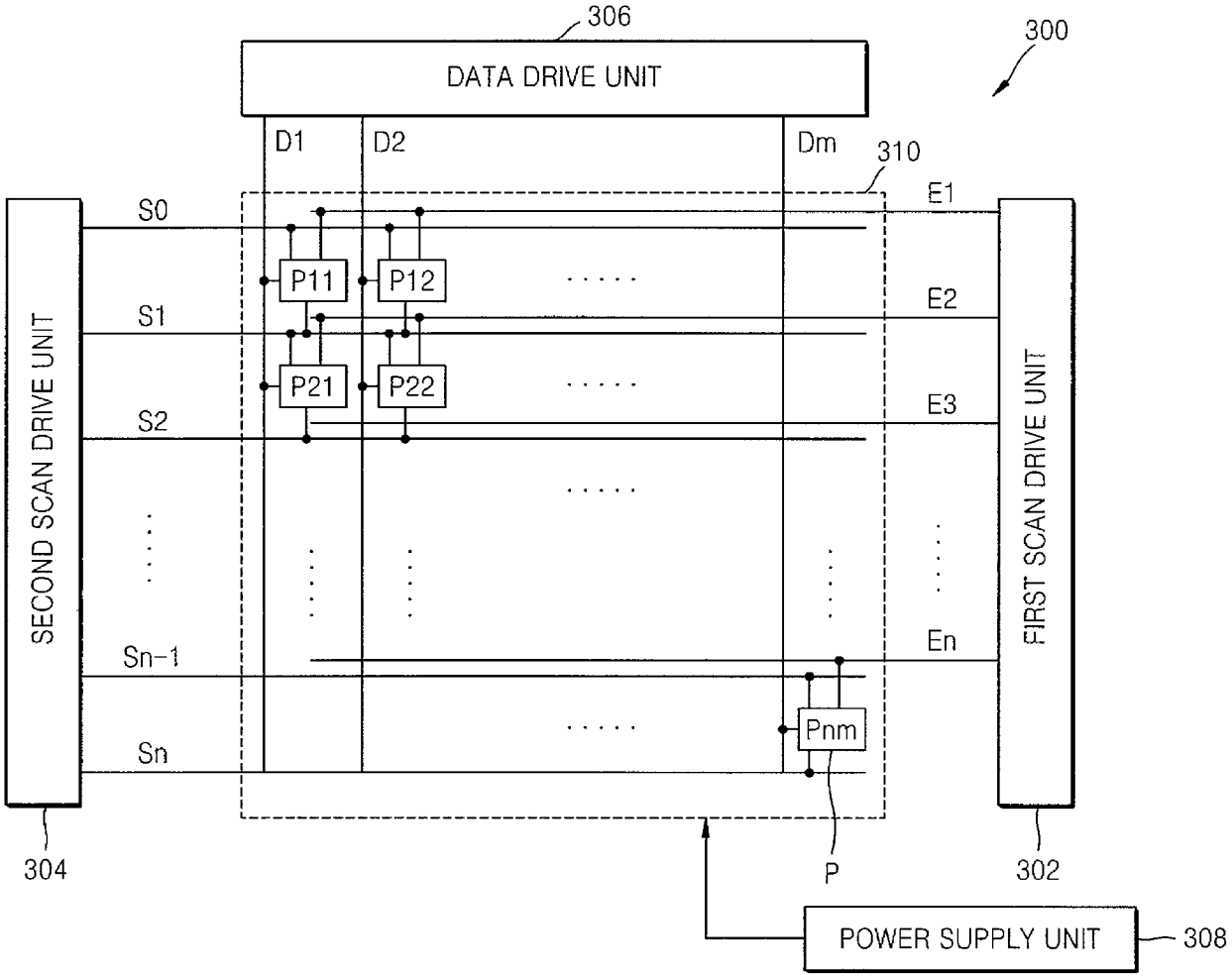
FIG. 3 is a block diagram of an organic electroluminescent display apparatus according to an exemplary embodiment of the present invention.

FIG. 3 is a block diagram of an organic electroluminescent display apparatus 300 according to an exemplary embodiment of the present invention. Referring to FIG. 3, the organic electroluminescent display apparatus 300 includes a display unit 310, a first scan drive unit 302 (e.g., a first scan driver), a second scan drive unit 304 (e.g., a second scan driver), a data drive unit 306 (e.g., a data driver), and a power supply unit 308 (e.g., a power supply). The first scan drive unit 302, the second scan drive unit 304, the data drive unit 306, and the power supply unit 308 may be implemented in a single IC chip.

The display unit 310 includes n×m number of pixel circuits P (P11, P12, P21, P22, . . . , and Pnm), each having an OLED (e.g., shown in FIG. 4), n+1 number of scan lines extending in a row direction to transmit scan control signals S0, S1, S2, . . . , Sn−1, and Sn, m number of data lines extending in a column direction to transmit data signals D1, D2, . . . , and Dm, and n number of emission control lines extending in the row direction to transmit emission control signals E1, E2, . . . , and En.

The pixel circuits P receive the first power voltage ELVDD, the second power voltage ELVSS, a sustain voltage Vsus, and a reference voltage Vref, in addition to the scan control signals, the data signals, and the emission control signals, and form an image by allowing the OLEDs provided in the pixel circuits P to emit light. According to another exemplary embodiment of the present invention, to reduce the number of wirings for transmitting power, the sustain voltage Vsus instead of the reference voltage Vref may be applied to a node to which the reference voltage Vref is applied. Thus, according to one exemplary embodiment, the wirings for applying the reference voltage Vref may be reduced.

The first scan drive unit 302 is connected to the emission control lines and applies the emission control signals E1, E2, . . . , and En to the display unit 310. The second scan drive unit 304 is connected to the scan lines and applies the scan control signals S0, S1, S2, . . . , Sn−1, and Sn to the display unit 310. The data drive unit 306 is connected to the data lines and applied the data signals D1, D2, . . . , and Dm to the display unit 310. The data drive unit 306 supplies data current to the pixel circuits P during a programming time. The power supply unit 308 supplies the first power voltage ELVDD, the second power voltage ELVSS, the sustain voltage Vsus, and the reference voltage Vref to each of the pixel circuits P.

Figure 4:
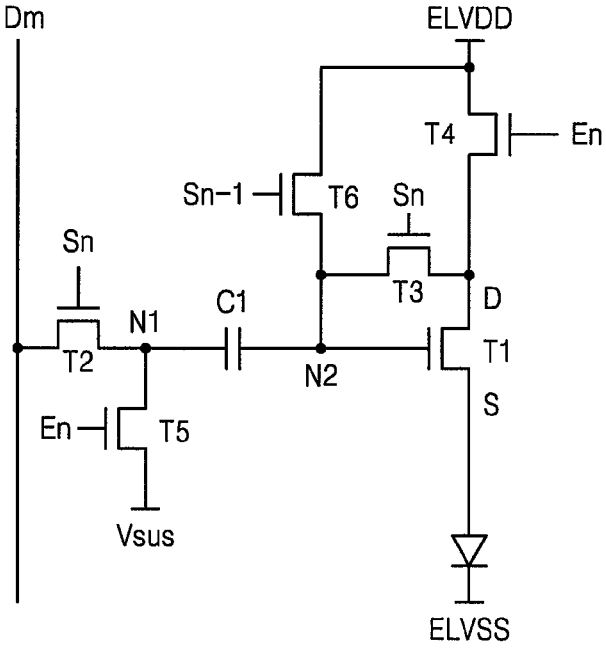
FIG. 4 is a circuit diagram of a pixel circuit P of the organic electroluminescent display apparatus of FIG. 3 according to an exemplary embodiment of the present invention.

FIG. 4 is a circuit diagram of the pixel circuit P of the organic electroluminescent display apparatus of FIG. 3 according to one embodiment. Referring to FIG. 4, a pixel circuit Pnm is located, for example, in the n-th row and the m-th column. The pixel circuit Pnm receives the data signal Dm through the data line 10 from the data drive unit 306 and outputs driving current according to the data signal Dm to the OLED. The pixel circuit Pnm according to the exemplary embodiment of FIG. 4 includes a driving (or first) transistor T1, second, third, fourth, fifth, and sixth transistors T2, T3, T4, T5, and T6, a light emitting device (e.g., OLED), and a capacitor C1.

The driving transistor T1 and the second to sixth transistors T2, T3, T4, T5, and T6 included in the pixel circuit Pnm may be N-type transistors such as N-type metal oxide semiconductor field effect transistors (MOSFETs). The N-type transistor is turned on when a signal applied to a gate electrode is a high level (the first level) and turned off when the signal is a low level (the second level). A transistor process using an oxide or amorphous-Si may be performed at a lower cost compared to a process using poly-Si. However, in a display panel formed primarily with an oxide or amorphous-Si transistor, the pixel circuits are implemented with N-type transistors for which characteristic deviation of the N-type transistors is compensated for. Thus, in the exemplary embodiment of FIG. 4, a pixel circuit is formed of N-type transistors.

The driving transistor T1 includes a first electrode D corresponding to a drain electrode and a second electrode S corresponding to a source electrode, and outputs driving current according to the voltage applied to a gate electrode of the driving transistor T1. As to the second transistor T2, the first electrode is connected to the data line and the second electrode, which is connected to the first terminal of a first capacitor C1, is connected to a first node N1. The second transistor T2 transmits the data signal Dm to the first node N1 in response to the scan control signal Sn applied to the gate electrode of the second transistor T2.

As to the third transistor T3, the first electrode, which is connected to the second electrode of the driving transistor T1, is connected to a second node N2, and the second electrode is connected to the first electrode of the driving transistor T1. The third transistor T3 diode-connects the driving transistor T1 in response to the scan control signal Sn applied to the gate electrode of the third transistor T3.

As to the fourth transistor T4, the first electrode is connected to the first power voltage ELVDD, and the second electrode is connected to the first electrode of the driving transistor T1. The fourth transistor T4 applies the first power voltage ELVDD to the first electrode of the driving transistor T1 in response to the emission control signal En.

As to the fifth transistor T5, the first electrode is connected to the first node N1 and the first electrode of the first capacitor, and the second electrode is connected to a source for supplying the sustain voltage Vsus. The fifth transistor T5 applies the sustain voltage Vsus to the first node N1 in response to the emission control signal En.

As to the sixth transistor T6, the first electrode is connected to a source for supplying the first power voltage ELVDD, and the second electrode is connected to the second node N2 to which the gate electrode of the driving transistor T1 and the first electrode of the third transistor T3 are connected. The sixth transistor T6 applies the first power voltage ELVDD to the gate electrode of the driving transistor T1 in response to the scan control signal Sn−1 applied to the previous row of pixels.

In one embodiment, the light emitting device is an OLED and has the structure illustrated in FIG. 1. The OLED includes a first electrode corresponding to the anode electrode and a second electrode corresponding to the cathode electrode. According to one exemplary embodiment, the anode electrode of the OLED is connected to the source electrode of the driving transistor T1, and the cathode electrode of the OLED is connected to the second power voltage ELVSS. As to the first capacitor C1, the first terminal is connected to the first node N1, and the second terminal is connected to the gate electrode of the driving transistor T1.

Figure 5:
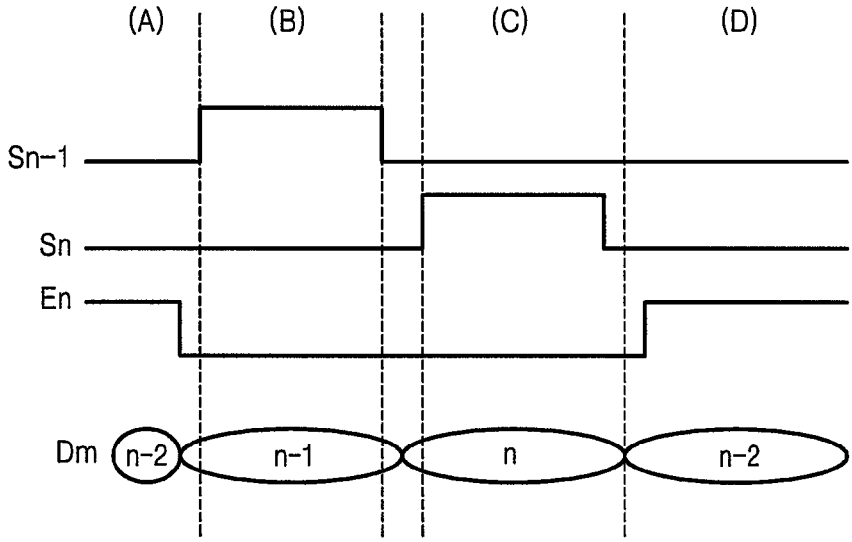
FIG. 5 is a timing diagram of drive signals according to an exemplary embodiment of the present invention.

FIG. 5 is a timing diagram of drive signals according to an exemplary embodiment of the present invention. FIGS. 6-9 are circuit diagrams sequentially showing the operation of the pixel circuit of FIG. 4 according to the timing diagram of FIG. 5.

Referring to FIG. 5, in period (A), the (n−1)th scan control signal Sn−1 applied to the previous row of pixels and the n-th scan control signal Sn are at the second level (e.g., low level) and the n-th emission control signal En is at the first level. Thus, the fourth and fifth transistors T4 and T5 are turned on, and the second, third, and sixth transistors T2, T3, and T6 are turned off.

Figure 6:
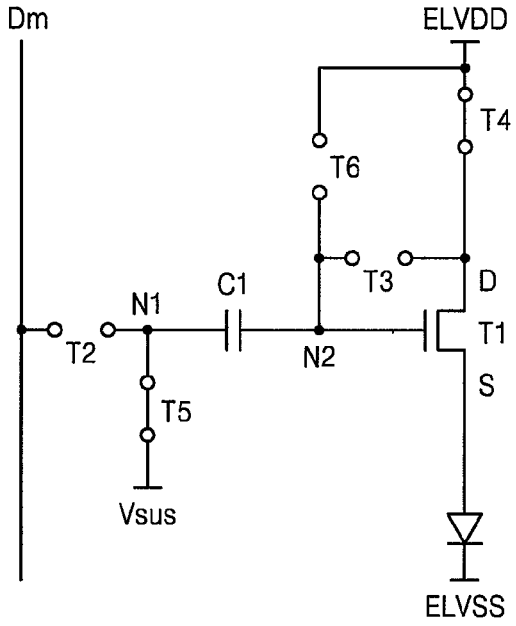
FIGS. 6, 7, 8, and 9 are circuit diagrams sequentially showing the operation of the pixel circuit of FIG. 4 according to the timing diagram of FIG. 5.

FIG. 6 illustrates the operation of the pixel circuit in period (A). Referring to FIG. 6, the fourth transistor T4 is turned on by the emission control signal En. Accordingly, driving current $I_{OLED}$ corresponding to the data signal Dm of a previous frame, which corresponds to the voltage of the gate electrode of the driving transistor T1 of a current frame, flows to the OLED so that the OLED may emit light. Also, since the fifth transistor T5 is turned on, the sustain voltage Vsus is applied to one terminal of the first capacitor C1 so that the first capacitor C1 may maintain the gate voltage of the driving transistor T1.

Next, an initialization operation is performed in period (B). In embodiments of the present invention, the initialization time is separated by adding the (n−1)th scan control signal. As the size of the organic electroluminescent display apparatus increases, the load on the initialization time increases. Accordingly, when the initialization and threshold voltage compensation of the transistor are performed at the same time, substantially, the time available for initialization may relatively decrease. In embodiments of the present invention, such a problem may be solved by separately performing the initialization.

In period (B), the (n−1)th scan control signal Sn−1 is shifted to the first level (e.g., a high level), and both of the n-th scan control signal Sn and the emission control signal En are at the second level (e.g., a low level). Thus, only the sixth transistor T6 is turned on, and the driving transistor T1 and the second to fifth transistors T2-T5 are all turned off.

Figure 7:
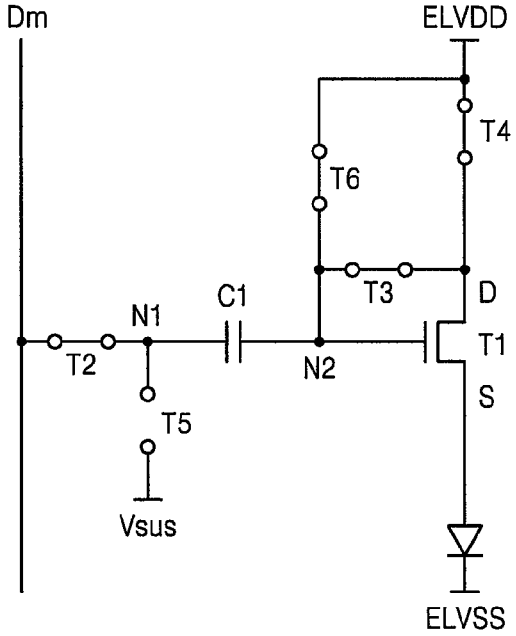

FIG. 7 illustrates the operation of the pixel circuit in period (B). Referring to FIG. 7, in period (B), the sixth transistor T6 is turned on so that the gate electrode of the driving transistor T1 may be initialized to the first power voltage ELVDD.

According to one embodiment of the present invention, the separation of the initialization period using the (n−1)th scan control signal has the following features. There is no need to maintain the data line in a high impedance state or form a switching device on the data line to prevent electrical short-circuit between the data signal Dm and the sustain voltage Vsus.

Next, in period (C), the (n−1)th scan control signal Sn−1 is shifted to the second level. The n-th scan control signal Sn is shifted to the first level. The emission control signal En maintains the second level. Accordingly, the second and third transistors T2 and T3 are turned on, whereas the fourth to sixth transistors T4-T6 are turned off.

Figure 8:
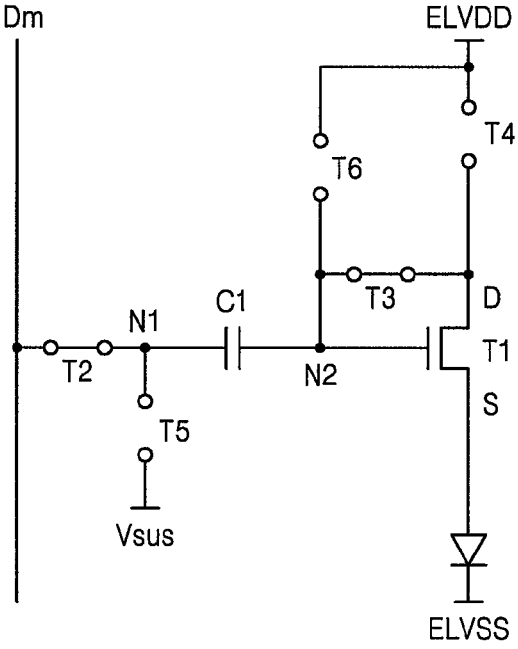

FIG. 8 illustrates the operation of the pixel circuit in period (C). Referring to FIG. 8, in period (C), data writing is performed, and the driving transistor T1 is diode-connected so that the threshold voltage Vth of the driving transistor T1 may be compensated for. As the second transistor T2 is turned on, the data signal Dm of the current frame is applied so that the voltage of the first node N1 may become data voltage Vdata. Also, the driving transistor T1 is diode-connected by the third transistor T3 so that a voltage as high as the threshold voltage Vth of the driving transistor T1 may be applied to the first and second electrodes of the third transistor T3.

Next, in period (D), the (n−1)th scan control signal Sn−1 maintains the second level. The n-th scan control signal Sn is shifted to the second level. The n-th emission control signal En is shifted to the first level. Thus, the fourth and fifth transistors T4 and T5 are turned on, and the second, third, and sixth transistors T2, T3, and T6 are turned off.

Figure 9:
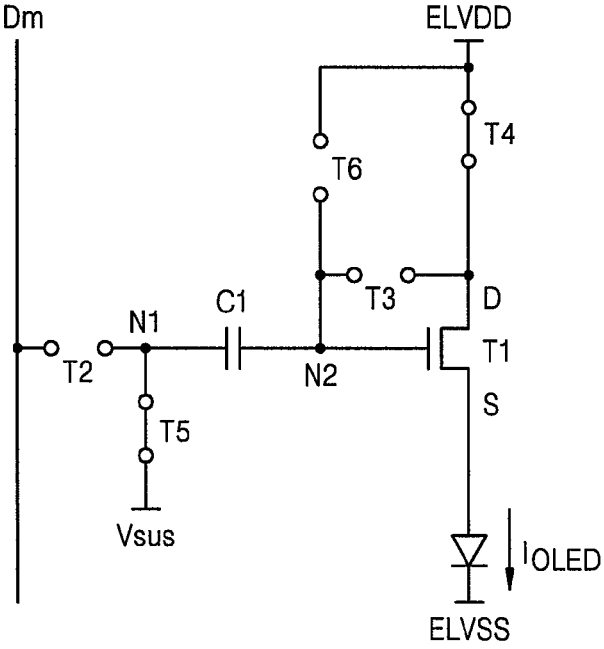

FIG. 9 illustrates the operation of the pixel circuit in period (D). Referring to FIG. 9, in period (D), current is applied to the OLED to emit light. As the fifth transistor T5 is turned on, the voltage of the first node N1 is changed from the reference data voltage Vdata to the sustain voltage Vsus. As the voltage of the first node N1 is changed from the Vdata to the Vsus, the voltage of the second node N2 is changed through the first capacitor C1 as much as the amount of a changed voltage of the first node N1, which is equal to Vsus-Vdata. As a result, the voltage difference between the gate voltage and the source voltage of the driving transistor T1 is (Vsus−Vdata)+Vth. Thus, driving current according to the voltage difference between the gate voltage and the source voltage of the driving transistor T1 is generated by the driving transistor T1. Since the fourth transistor T4 is turned on, the OLED driving current flows through the driving transistor T1 and the OLED. The voltage of the source electrode of the driving transistor T1 is the same as that of the anode electrode of the OLED, and the voltage of the anode electrode of the OLED is ELVSS+$V_{OLED}$. The $V_{OLED}$ is a voltage across the OLED during the light emission of the OLED. Since the voltage of the gate electrode of the driving transistor T1 is the voltage of the second node N2, the voltage of the gate electrode of the driving transistor T1 Vg changes as expressed by Equation 1.

$$Vg=(Vsus-V\text{data}+Vth)+(ELVSS+V_{OLED}) \quad \text{Equation 1}$$

Thus, in period (D), the voltage Vgs of the driving transistor T1 is as shown by Equation 2.

$$Vgs=[(Vsus-V\text{data}+Vth)+(ELVSS+V_{OLED})]-(ELVSS+V_{OLED}) \quad \text{Equation 2}$$

The driving current $I_{OLED}$ determined by the Vgs is determined as shown in Equations 3 and 4. In Equations 3 and 4, k=β/2, k is a constant, β is a gain factor.

$$\begin{aligned} I_{OLED} &= k[\{(Vsus - Vdata + Vth) + (ELVSS + V_{OLED}) - (ELVSS + V_{OLED})\} - Vth]^2 \\ &= k[(Vsus - Vdata + Vth) - Vth]^2 \end{aligned} \quad \text{Equation 3}$$

$$I_{OLED} = k(Vsus - Vdata)^2 \quad \text{Equation 4}$$

Thus, the driving current $I_{OLED}$ output from the pixel circuit according to the exemplary embodiment of FIG. 4 is determined regardless of the voltage of the anode electrode of the OLED, the second power voltage ELVSS, and the threshold voltage Vth of the driving transistor T1. Accordingly, in the exemplary embodiment of FIG. 4, since the amount of the driving current $I_{OLED}$ is not changed by the voltage of the anode electrode of the OLED, an increase of the voltage of the data signal Dm and the deterioration of image quality may be prevented. Also, the above described exemplary embodiments of the present invention may prevent the deterioration of the image quality due to the IR drop of the second power voltage ELVSS.

Also, according to the above described embodiments of the present invention, by separating the initialization time by adding the (n−1)th scan control signal, the initialization time is sufficiently secured in a large size organic electroluminescent display apparatus so that contrast ratio may be improved.

Figure 10:
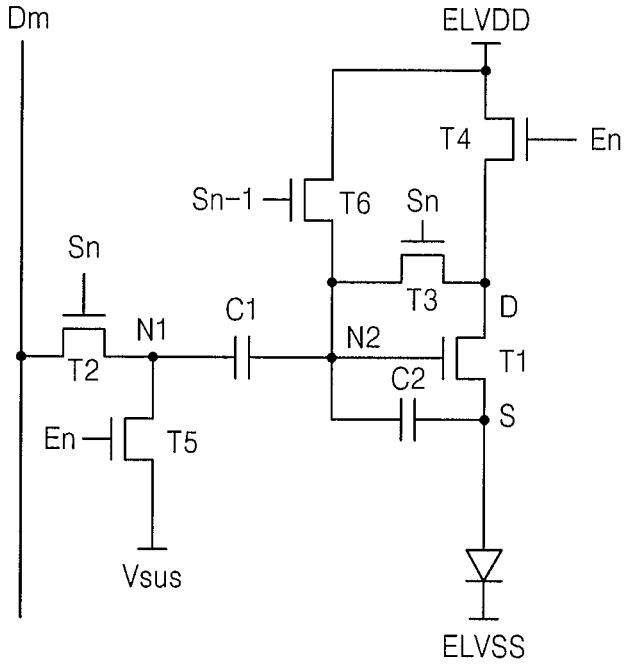
FIGS. 10, 11, 12, 13, and 14 are circuit diagrams showing the structures of pixel circuits according to other exemplary embodiments of the present invention.

FIG. 10 is a circuit diagram showing the structure of a pixel circuit according to another exemplary embodiment of the present invention. Referring to FIG. 10, a second capacitor C2 to be charged with the threshold voltage Vth of the driving transistor T1 may be additionally provided between the gate electrode and the source electrode, which is connected to the anode electrode of the OLED, of the driving transistor T1. The method of driving a pixel circuit according to the exemplary embodiment of FIG. 10 is the same as the method illustrated in reference to FIGS. 4 and 5. When the OLED emits light, the second capacitor C2 functions as an additional storage capacitor, with the first capacitor C1.

Figure 11:
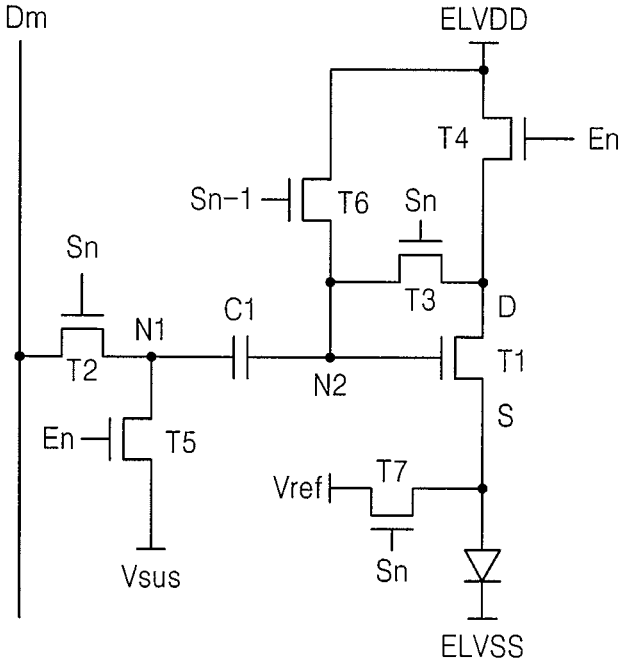

FIG. 11 is a circuit diagram showing the structure of a pixel circuit according to another exemplary embodiment of the present invention. Referring to FIG. 11, an electrode of a seventh transistor T7 is connected between the source electrode of the driving transistor T1 and the anode electrode of the OLED. The seventh transistor T7 applies the reference voltage Vref to the source electrode of the driving transistor T1 in response to the n-th scan control signal. According to the exemplary embodiment of FIG. 11, the seventh transistor T7 is turned on when the n-th scan control signal is shifted to the first level in period (C). The source voltage of the driving transistor T1 is fixed to the reference voltage Vref. That is, the seventh transistor T7 functions to fix the source voltage of the driving transistor T1 during the compensation of the threshold voltage Vth of the driving transistor T1 and the data writing of the pixel circuit according to the embodiment of FIG. 11. The voltage level of the reference voltage Vref should be less than the sum of the second power voltage ELVSS and the threshold voltage of the OLED. If the voltage level of the reference voltage Vref is greater than the sum of the second power voltage ELVSS and the threshold voltage of the OLED, during the initialization of the pixel circuit, the data writing, and the compensation of the threshold voltage Vth of the driving transistor T1, current flows through the OLED due to the voltage difference so that the OLED may emit light undesirably.

Figure 12:
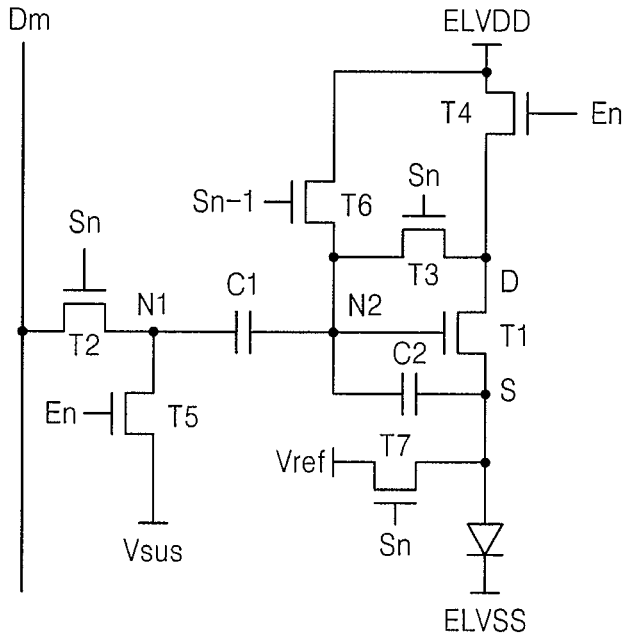

FIG. 12 is a circuit diagram showing the structure of a pixel circuit according to another exemplary embodiment of the present invention. Referring to FIG. 12, both of the second capacitor C2 of FIG. 10 and the seventh transistor T7 of FIG. 11 are included in the pixel circuit of FIG. 12. Thus, since the driving method is the same as those described with reference to FIGS. 10 and 11, a detailed description thereof will be omitted herein.

Figure 13:
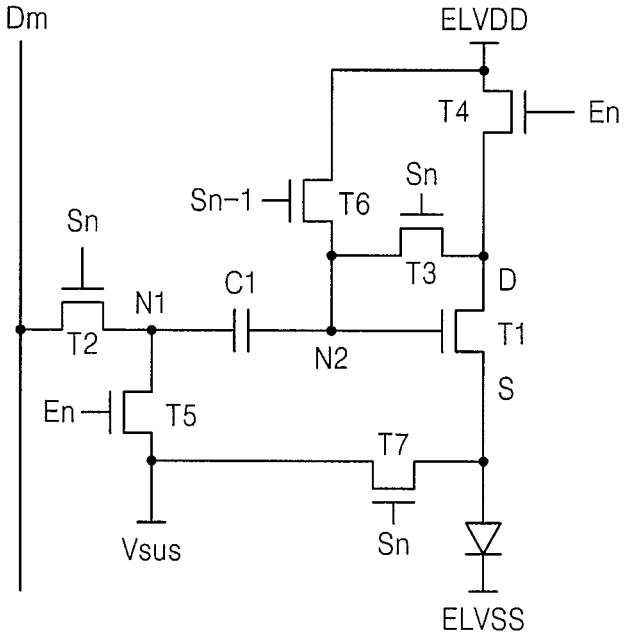

FIG. 13 is a circuit diagram showing the structure of a pixel circuit according to another exemplary embodiment of the present invention. Referring to FIG. 13, according to the present exemplary embodiment, the seventh transistor T7 is connected to the source electrode of the driving transistor T1. The seventh transistor T7 applies the sustain voltage Vsus to the source electrode of the driving transistor T1 in response to the n-th scan control signal. The sustain voltage Vsus is used instead of the reference voltage Vref, as shown in the embodiment of FIG. 12. Thus, the number of power sources and wirings may be reduced.

Figure 14:
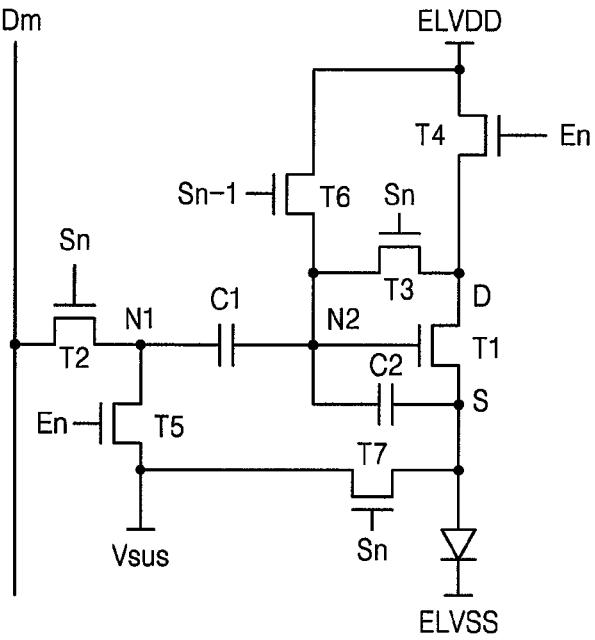

FIG. 14 is a circuit diagram showing the structure of a pixel circuit according to another exemplary embodiment of the present invention. Referring to the embodiment of FIG. 14, the structure of the pixel circuit includes the seventh transistor T7 for applying the sustain voltage Vsus of FIG. 13 added to the pixel circuit of FIG. 12.

Figure 15:
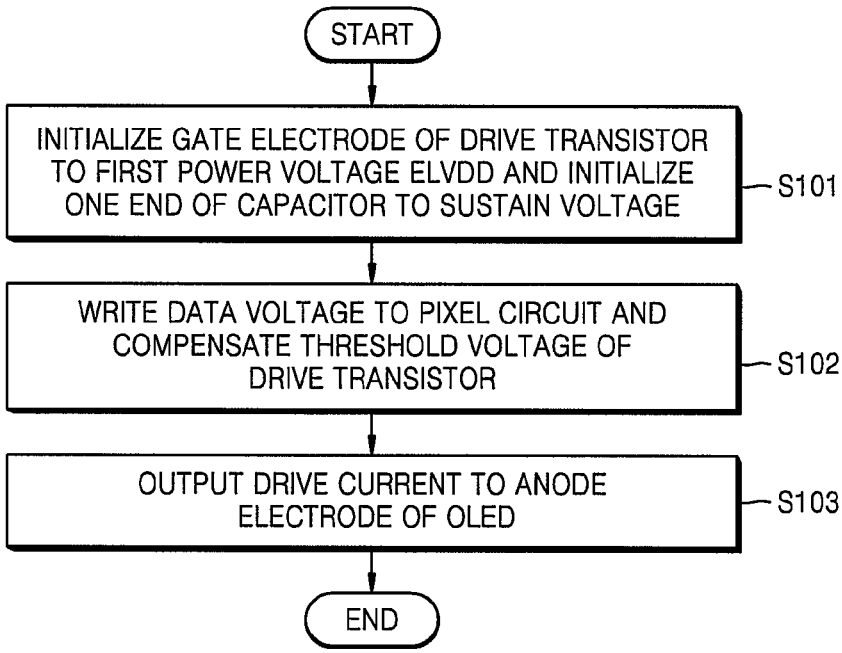
FIG. 15 is a flowchart for explaining a method of driving an organic electroluminescent display apparatus according to an exemplary embodiment of the present invention.

FIG. 15 is a flowchart for explaining a method of driving an organic electroluminescent display apparatus according to an exemplary embodiment of the present invention. Referring to FIG. 15, an operation S101 corresponds to period (B) of FIG. 5. First, the gate electrode of the driving transistor T1 is initialized to the first power voltage ELVDD in response to the initialization control signal Sn−1. Also, one terminal of the capacitor C1 included in the pixel circuit is initialized to the sustain voltage Vsus.

An operation S102 corresponds to period (C) of FIG. 5. The data signal Dm is applied to the pixel circuit via the second transistor T2 in response to the scan control signal Sn. The third transistor T3 is diode-coupled to the driving transistor T1 (i.e., T1 is diode-connected by T3) so that the threshold voltage Vth of the driving transistor T1 may be compensated for. In more detail, the capacitor C1 is charged with a voltage corresponding to the voltage difference between the data voltage Vdata and the threshold voltage Vth of the driving transistor T1.

Next, an operation S103 corresponds to period (D) of FIG. 5. In response to the emission control signal En, the fifth transistor T5 is turned on, and the sustain voltage Vsus is applied to the pixel circuit so that the gate voltage of the driving transistor T1 may be changed accordingly. Also, the driving current $I_{OLED}$ is output to the anode electrode of the OLED. The amount of the driving current $I_{OLED}$ is determined according to the voltage level Vdata of the data signal Dm stored in the capacitor C1, as expressed by Equation 4. Accordingly, the OLED may emit light having a brightness corresponding to the amount of the driving current $I_{OLED}$.

As described above, according to the exemplary embodiments of the present invention, since the driving current input to the OLED is determined regardless of the threshold voltage of the driving transistor and the second power voltage applied at the cathode of the OLED, the IR drop generated due to the deviation in the threshold voltage of the driving transistor and the parasitic resistance element of the wiring for transferring the second power voltage may be removed. Also, the number of wirings applied to each pixel circuit may be reduced.

While this invention has been particularly shown and described with reference to exemplary embodiments thereof, it will be understood by those skilled in the art that various changes in form and details may be made therein without departing from the spirit and scope of the present invention as defined by the appended claims and their equivalents.

What is claimed is:

1. A pixel circuit comprising:

a light emitting device comprising a first electrode and a second electrode;

a first transistor comprising a first electrode and a second electrode and for outputting a driving current according to a voltage applied to a gate electrode of the first transistor;

a first capacitor comprising a first terminal, and a second terminal coupled to the gate electrode of the first transistor;

a second transistor for transferring a data signal to the first terminal of the first capacitor in response to a scan control signal applied to a gate electrode of the second transistor;

a third transistor for diode-connecting the first transistor in response to the scan control signal applied to a gate electrode of the third transistor;

a fourth transistor for applying a first power voltage to the first electrode of the first transistor in response to an emission control signal;

a fifth transistor for applying a sustain voltage to the first terminal of the first capacitor in response to the emission control signal; and a sixth transistor for applying the first power voltage to the second terminal of the first capacitor in response to an initialization control signal, wherein the first transistor and the second to sixth transistors are N-type transistors.

2. The pixel circuit of claim 1, wherein the first transistor and the second to sixth transistors are N-type metal oxide semiconductor field effect transistors (MOSFETs).

3. The pixel circuit of claim 1, wherein the second transistor comprises a first electrode coupled to a data line and a second electrode coupled to the first terminal of the first capacitor, and the third transistor comprises a first electrode coupled to the gate electrode of the first transistor and a second electrode coupled to the first electrode of the first transistor.

4. The pixel circuit of claim 1, wherein the scan control signal and the emission control signal are signals applied to an n-th row of pixels, and the initialization control signal is a signal applied to an (n−1)th row of pixels.

5. The pixel circuit of claim 1, wherein the first electrode of the first transistor is a drain electrode, and the second electrode of the first transistor is a source electrode.

6. The pixel circuit of claim 1, wherein the light emitting device is an organic light emitting diode (OLED).

7. The pixel circuit of claim 1, further comprising a second capacitor comprising a first terminal coupled to the gate electrode of the first transistor and a second terminal coupled to the first electrode of the light emitting device.

8. The pixel circuit of claim 1, further comprising a seventh transistor for applying a reference voltage to the first electrode of the light emitting device in response to the scan control signal applied to a gate electrode of the seventh transistor.

9. The pixel circuit of claim 8, wherein the reference voltage is substantially the same as the sustain voltage.

10. The pixel circuit of claim 1, wherein the scan control signal and the emission control signal are driven in a first period, a second period, and a third period, in the first period, a previous scan control signal is at a first level, and the emission control signal and the scan control signal are at a second level;

in the second period, the data signal having an effective level is applied to the pixel circuit, the previous scan control signal is at the second level, the scan control signal is at the first level, and the emission control signal is at the second level; and in the third period, the previous scan control signal is at the second level, the scan control signal is at the second level, and the emission control signal is at the first level, and wherein the first level is a level at which the first transistor and the second to sixth transistors are turned on, and the second level is a level at which the first transistor and the second to sixth transistors are turned off.

11. An organic electroluminescent display apparatus comprising:

a plurality of pixels;

a first scan driver for outputting an emission control signal to each of the plurality of pixels, and a second scan driver for outputting a scan control signal to each of the plurality of pixels; and a data driver for generating a data signal and outputting to output the generated data signal to each of the plurality of pixels, wherein each of the plurality of pixels comprises:

an organic light emitting diode comprising an anode electrode and a cathode electrode;

a first transistor comprising a first electrode and a second electrode and for outputting a driving current according to a voltage applied to a gate electrode of the first transistor;

a first capacitor comprising a first terminal and a second terminal coupled to the gate electrode of the first transistor;

a second transistor for transferring the data signal to the first terminal of the first capacitor in response to an n-th scan control signal applied to a gate electrode of the second transistor;

a third transistor for diode-connecting the first transistor in response to the n-th scan control signal applied to a gate electrode of the third transistor;

a fourth transistor for applying a first power voltage to the first electrode of the first transistor in response to an n-th emission control signal;

a fifth transistor for applying a sustain voltage to the first terminal of the first capacitor in response to the n-th emission control signal; and a sixth transistor for applying the first power voltage to the second terminal of the first capacitor in response to an (n−1)th scan control signal, and wherein the first transistor and the second to sixth transistors are N-type transistors.

12. The organic electroluminescent device apparatus of claim 11, wherein the first electrode of the first transistor is a drain electrode, and the second electrode of the first transistor is a source electrode.

13. The organic electroluminescent device apparatus of claim 11, further comprising a second capacitor comprising a first terminal coupled to the gate electrode of the first transistor and a second terminal coupled to the anode electrode of the organic light emitting diode.

14. The organic electroluminescent device apparatus of claim 11, further comprising a seventh transistor for applying a reference voltage to the anode electrode of the organic light emitting diode in response to the scan control signal applied to a gate electrode of the seventh transistor.

15. The organic electroluminescent device apparatus of claim 14, wherein the reference voltage is substantially the same as the sustain voltage.

16. The organic electroluminescent device apparatus of claim 11, wherein the first scan driver and the second scan driver are driven in a first period, a second period, and a third period, the second scan driver is configured to apply in the first period the (n−1)th scan control signal at a first level and the n-th scan control signal at a second level, and the first scan driver is configured to apply in the first period the n-th emission control signal at a second level;

the data driver is configured to apply in the second period the data signal at an effective level to each of the plurality of pixels, the second scan driver is configured to apply in the second period the (n−1)th scan control signal at the second level and the n-th scan control signal at the first level, and first scan driver is configured to apply in the second period the n-th emission control signal at the second level; and the second scan driver is configured to apply in third period the (n−1)th scan control signal at the second level and the n-th scan control signal at the second level, and the first scan driver is configured to apply in third period the n-th emission control signal at the first level, and wherein the first level is a level at which the first transistor and the second to sixth transistors are turned on, and the second level is a level at which the first transistor and the second to sixth transistors are turned off.

* * * * *